US005890985A

United States Patent [19]

Jenney

[11] Patent Number: 5,890,985

[45] Date of Patent: Apr. 6, 1999

[54] BASKETBALL TRAINING AID

[76] Inventor: George Warren Jenney, 342 Washington Ave., Barberton, Ohio 44203

[21] Appl. No.: 912,957

[22] Filed: Aug. 17, 1997

[51] Int. Cl.[6] ..... A63B 69/00

[52] U.S. Cl. ..... 473/447

[58] Field of Search ..... 473/447, 448; 273/317.3; 434/248

[56] References Cited

U.S. PATENT DOCUMENTS

| | | | |
|---|---|---|---|
| D. 321,370 | 11/1991 | Curtis | D19/62 |
| D. 370,242 | 5/1996 | Bright | D21/201 |
| 3,552,749 | 1/1971 | Piggotte | 473/448 |
| 4,989,862 | 2/1991 | Curtis | 473/448 |
| 5,271,617 | 12/1993 | Gilford | 473/447 |
| 5,485,993 | 1/1996 | Lipsett | 473/447 |
| 5,527,185 | 6/1996 | Davis | 473/447 X |

*Primary Examiner*—William H. Grieb

[57] ABSTRACT

A portable basketball training aid to improve the player's shooting accuracy while being distracted by vision restrictors which simulate realistic game conditions. The training aid is used, in the vicinity of an elevated basketball hoop and board. The training aid includes a plurality of height extendible flexiable supports extending upward from the top of the hollow support member in a direction approximately parallel to the support member. The training aid has an upper extent and a lower extent, the lower extent being attached to a compressible anchor member made from any suitable material and shape, for example, a foam cylinder. The compressible anchor member is confined within the rigid hollow support member and held in place by friction. The friction being formed at the intersection of the compressible member and the inside wall of the rigid hollow member. In its uncompressed state, the compressible member is of a width greater than the inside width of the hollow member. The upper extent of each flexible support is affixed to the attached vision restrictor. The anchor member is retained from exiting the hollow support member by a cap. The flexible supports for the vision restrictors pass through the cap to force separation of the restrictors when in their extended positions. The material of the supports being such as to undergo bending deflection responsive to air movement. The bending deflection enables the vision restrictors to move in the presence of minimal wind simulating the distractive efforts of an opponent's guarding technique.

7 Claims, 5 Drawing Sheets

BASKETBALL TRAINING AID

BACKGROUND OF THE INVENTION

The sport of basketball continues to be increasingly popular at all levels of play. Children start at a very early age to shoot baskets, and the best of them will ultimately play organized competitive basketball for many years and may even achieve the level of playing professional basketball. At all levels of play, one of the keys to success is the ability to make a high percentage of goals and improved shooting accuracy is important. Even gifted athletes have found that the only proven way to improve shooting accuracy is dedication and hard work. In other words, the only way to improve shooting accuracy is to practice and attain a level of shooting confidence that will enable the athlete to perform more successfully no matter at what level the athlete is competing. However there has been no way to simulate the game like distractive efforts of an opponent's hands-in-your-face guarding technique during individual practice sessions. Thus, a key element of shooting over the waving, outstreched hands of an opponent, as exists in a real game, has always been missing from individual practice.

There is a need for a practice or training aid, no matter at what level, elementary, high school, college or professional, that will enable the athlete to improve his or her shooting accuracy under the most realistic game conditions.

There is also a need for any practice or training apparatus which will improve shooting accuracy under the most realistic game conditions which is easy to use and which is inexpensive.

DESCRIPTION OF THE PRIOR ART

Attempts to meet the above criterion include several basketball training aids.

One design is disclosed in U.S. Pat. No. D321,370 to Curtis which provides a drawing of a basketball player with his arms raised (FIG. 1). One disadvantage of this design is the inablility to make height adjustments for different players. So if such a design were incorporated in a training aid, multiple aids would be required to accomodate, for example, the height range on the average school basketball team. Moreover, the Curtis design implies a static aid rather than one exhibiting game condition motion and distraction.

U.S. Pat. No. D 370,242 to Bright disclosed a design which shows a single motionless hand held vertically (FIG. 2). First, no means are provided for motion, simulating realistic game conditions with the opponents waving hands. Secondly, no description is given indicating the ability to adjust for height.

U.S. Pat. No. 5,485,993 to Lipsett disclosed a basketball training apparatus having spring activated metal arms with restricted, non random like motion which are intended to physically block a player's arm FIG. 3, as opposed to restricting the vision of the basket. In addition, this apparatus is of complicated construction and would therefore be expensive to produce and of limited availibility due to its high price.

U.S. Pat. No. 5,271,617 to Gilford disclosed a basketball training device which is typical of many such arm braces. These devices are complicated to use, and must be physically attached to the individual player, thereby providing no means for those who may be physically impaired, in those areas of the attachment, to use them. Due to the nature of their construction, in addition to not simulating game conditions, they are expensive to produce, thus eliminating from their market economically disadvantages schools and individuals.

While these devices fulfill their respective, particular objective and requirements, the aforementioned patents do not describe individually, height adjustable, moving, vision restrictors which provide realistic simulation of game condition distractions during practice sessions.

Therefore, it can be appreciated that there exists a continuing need for a new and improved training aid which is inexpensive to manufacture, easy to assemble and use and which can provide realistic game like distractions for basketball athletic practice. In this regard, the present invention substantially fulfills this need.

In this respect, the present invention substantially departs from the conventional concepts and designs of the prior art, and in doing so provides an apparatus primarialy developed for the purpose of providing a moving, vision restricting, training aid which simulates realistic game enviornment distractions during individual basketball practice sessions.

SUMMARY OF THE INVENTION

In view of the foregoing disadvantages inherent in the known types of assorted basketball training aids now present in the prior art, it should be apparent that a need still exists in the art for an invention which provides improved individually, height adjustable, moving, vision restrictors in order to provide realistic simulation of game condition distractions during individual practice sessions. As such, the present invention, which overcomes the aforesaid disadvantages of the prior art will be described subsequently in greater detail.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved individually, height adjustable, moving, vision restrictor for providing realistic simulation of game condition distractions during practice sessions which has all the advantages of the prior art and none of the disadvantages.

It is another object of the present invention to provide a new and improved individually, height adjustable, moving, vision restrictor for providing realistic simulation of game condition distractions during practice sessions which may be easily and efficiently manufactured and marketed.

It is a further object of the present invention to provide a new and improved individually, height adjustable, moving, vision restrictor for providing realistic simulation of game condition distractions during practice sessions which is of durable and reliable construction.

It is a further object of the present invention to provide a new and improved individually, height adjustable, moving, vision restrictor for providing realistic simulation of game condition distractions during practice sessions which thus eliminates the need for duplicate equipment within schools to accommodate students of varying heights and for duplicate equipment for parents having children of various grade levels and heights within the same family.

It is a further object of the present invention to provide a new and improved individually, height adjustable, moving, vision restrictor for providing realistic simulation of game condition distractions during practice sessions which will not further inhibit players who have physical limitations or handicaps due to straps, buckles or attachments which require specific body parts and specific sizes for the attachments.

It is an even further object of the present invention to provide a new and improved individually, height adjustable, moving, vision restrictor for providing realistic simulation of game condition distractions during practice sessions which is susceptible of a low cost of manufacture with regard to both materials and labor, and which accordingly is then susceptible of low prices of sale to the consuming public, thereby making such a new and improved individually, height adjustable, moving, vision restrictor for providing realistic simulation of game condition distractions during practice sessions, training aid economically available to the buying public.

Still yet another object of the present invention is to provide a new and improved individually, height adjustable, moving, vision restrictor for providing realistic simulation of game condition distractions during practice sessions which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects atttained by its uses, references should be had to the accompanying drawing and descriptive nattter in which there is illustrated preferred embodiments of the invention.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

BRIEF DESCRIPTION OF THE DRAWINGS

The invention will be better understood and objects other than those set forth above will become apparent when consideration is given to the following detailed dedscription thereof. Such description makes reference to the annexed drawings wherein.

DESCRIPTION OF THE PREFERRED EMBODIMENT OF THE INVENTION

Figure 1:
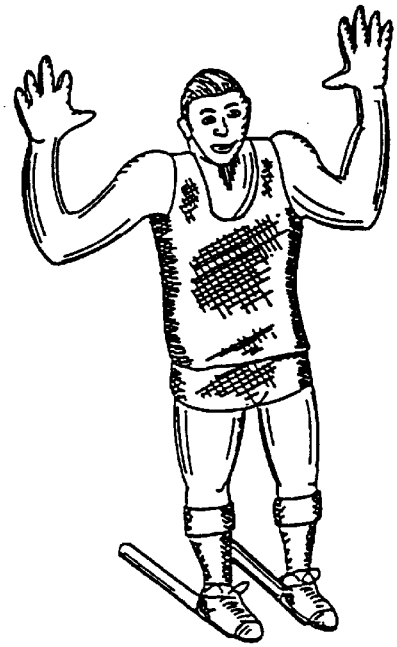
Fig. 1 PRIOR ART
FIG. 1 is a view of one possible embodiment of the prior art, cardboard man.
Figure 2:
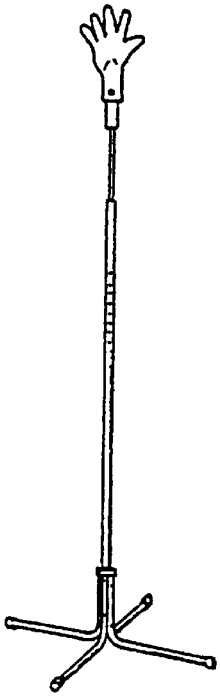
Fig. 2 PRIOR ART
FIG. 2 is a view of the prior art, pole with hand.
Figure 3:
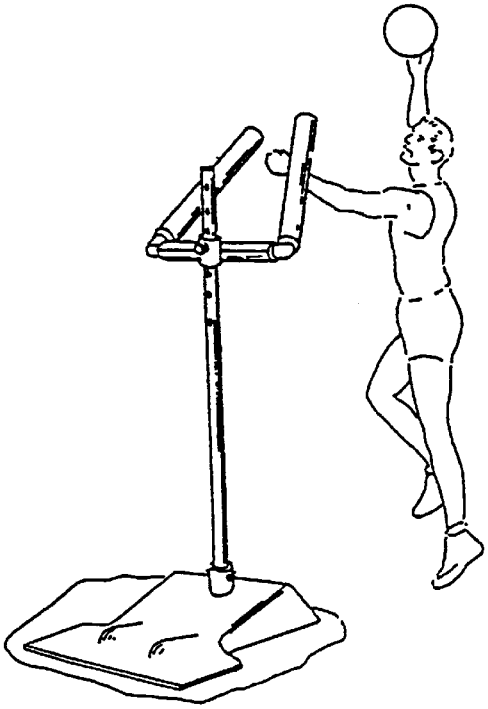
Fig. 3 PRIOR ART
FIG. 3 is a view of one possible embodiment of the prior art, metal arms.

While this invention is susceptible of embodiment in many different forms, there is shown in the drawings and will herin be described in detail, three specific embodiments, with the understanding that the present disclosure is to be considered as an exemplification of the principles of the invention and is not intended to limit the invention the the embodiments illustrated.

Figure 4:
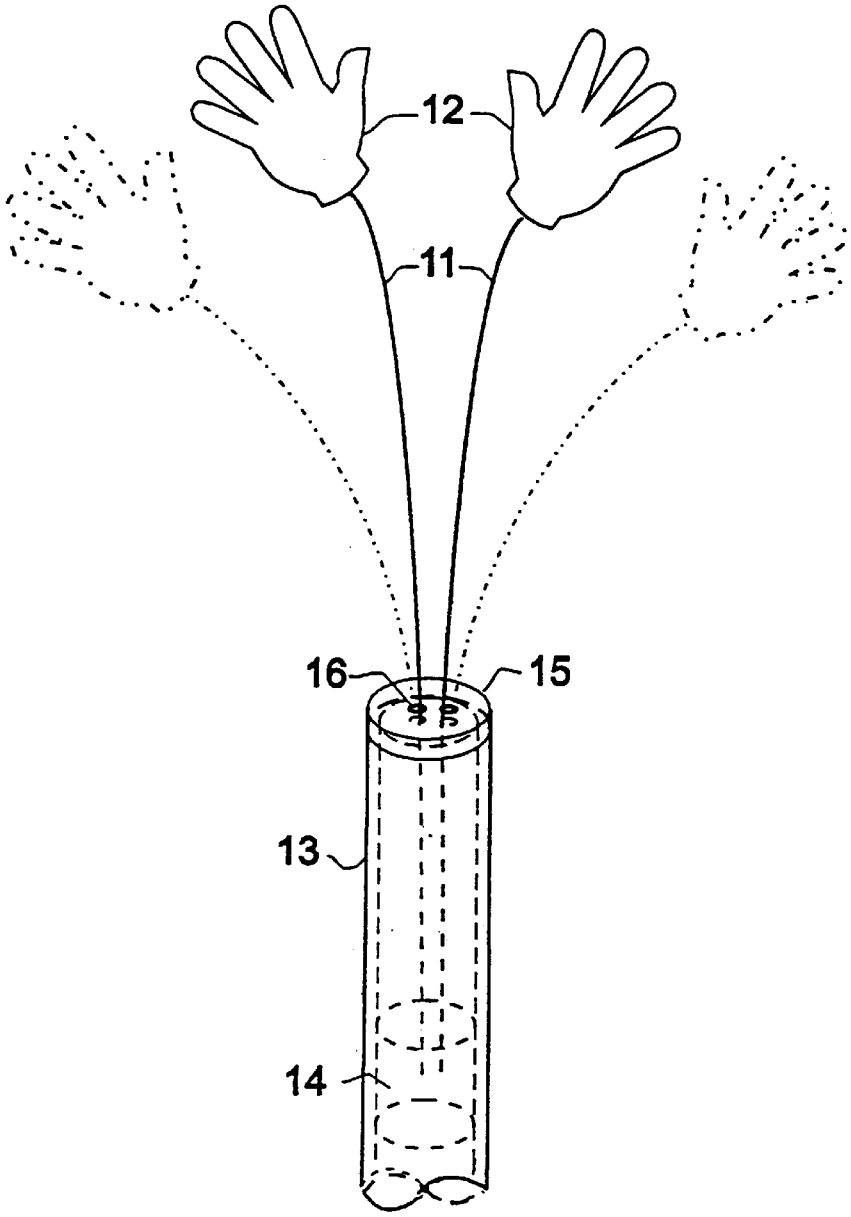
FIG. 4 is a perspective view of the present invention.

Referring now in detail to the drawings wherein like parts are designated by like reference numerals throughout to the drawings, there is illustrated in FIG. 4 a perspective view of the training aid. The device of the invention is a plurality of flexiable supports 11 with vision restrictors 12 affixed at the upper most end, and a device which both holds the flexiable supports 11 firmly in place and allows for vertical adjustment, affixed at the bottom 13. The flexiable supports 11 being thin and of such flexability and strength as to undergo bending deflection responsive to air movement so as to enable the vision restrictors 12 attached to the top to move in the presence of minimal wind. The vision restrictors may take a variety of shapes within predetermined weight limits so as to not interfer with the flexibility and function of the flexible supports.

Affixed to the bottom portion of each flexiable support is the compressible anchor member 14, as a means of holding the flexiable supports in place. The rigid hollow member 13 is of smaller diameter than the compressible anchor member 14. This creates friction at the point of intersection between the compressible anchor member 14 and the inside of the rigid hollow member 13 which must be overcome by pulling or pushing on the flexiable supports 11 to change the overall height of the training aid. The flexiable supports 11 are held in place by the upstanding rigid hollow member 13. The upstanding rigid hollow member 13 can be made from any suitable material such as aluminum, plastic, wood, etc. so that it is both lightweight and durable, and has a predetermined height and a predetermined width. The bottom end of the rigid hollow member 13 is mounted in a generic, conventional base mount, not shown. The uppermost end of the rigid hollow member 13 is capped.

The cap 15 is permenantly attached to the rigid hollow member 13 so as to prevent the compressible anchor member 14 from exiting the rigid hollow member 13. The cap 15, has a plurality of holes 16, spaced at such a distance so as to force the vision restrictors 11 to spread apart when the flexiable supports are pulled upwardly out of the rigid hollow member 13 with the distence between the vision restrictors being extended substantially as the flexiable supports extend upward. This corresponds to the increased armspread of taller players.

Figure 5:
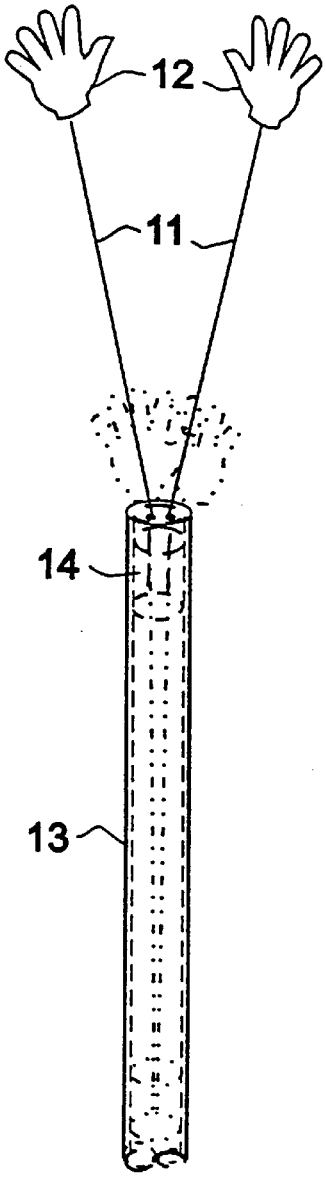
FIG. 5 is a reduced persepective view of the present invention showing vertical range.

The object of the present invention is to provide a portable basketball training aid with moving vision restrictors which simulate the distractive efforts of an opponent's hands-in-your-face guarding technique, thus providing realistic game condition vision distractions during practice sessions. The flexiable supports 11 can be adjusted vertically for individual height preferences in vision restriction during shooting practice. The vision restrictors, as illustrated, take the form of a hand, however, they may assume any pratical shape or color as deemed appropriate within predetermined size and predetermined weight limits thus not interfering with the flexibility and function of the flexible supports. As illustrated in FIG. 5, the flexiable supports 11 can be fully inserted into the rigid hollow member 13 for convient storage when the apparatus is not in use. The bottom of the rigid support member 13 is supported by a generic conventional base mount, not shown.

Figure 8:
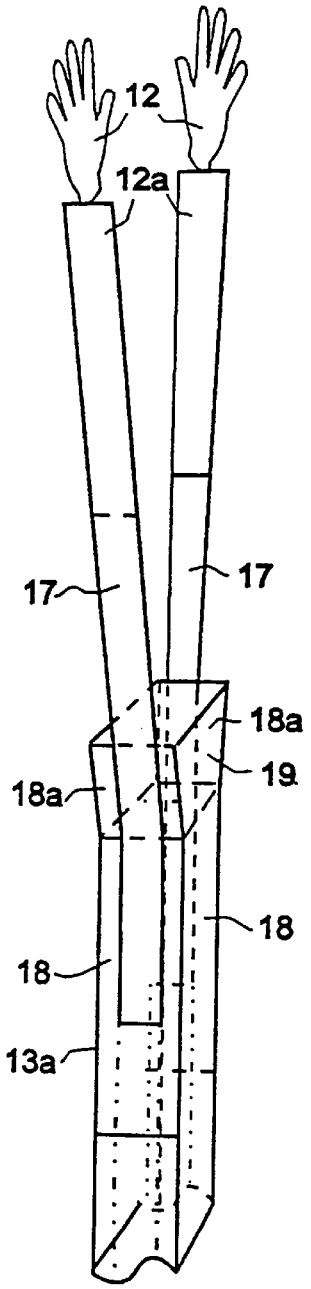
FIG. 8 is a perspective view of the present invention in another embodiment using Velcro.
Figure 9:
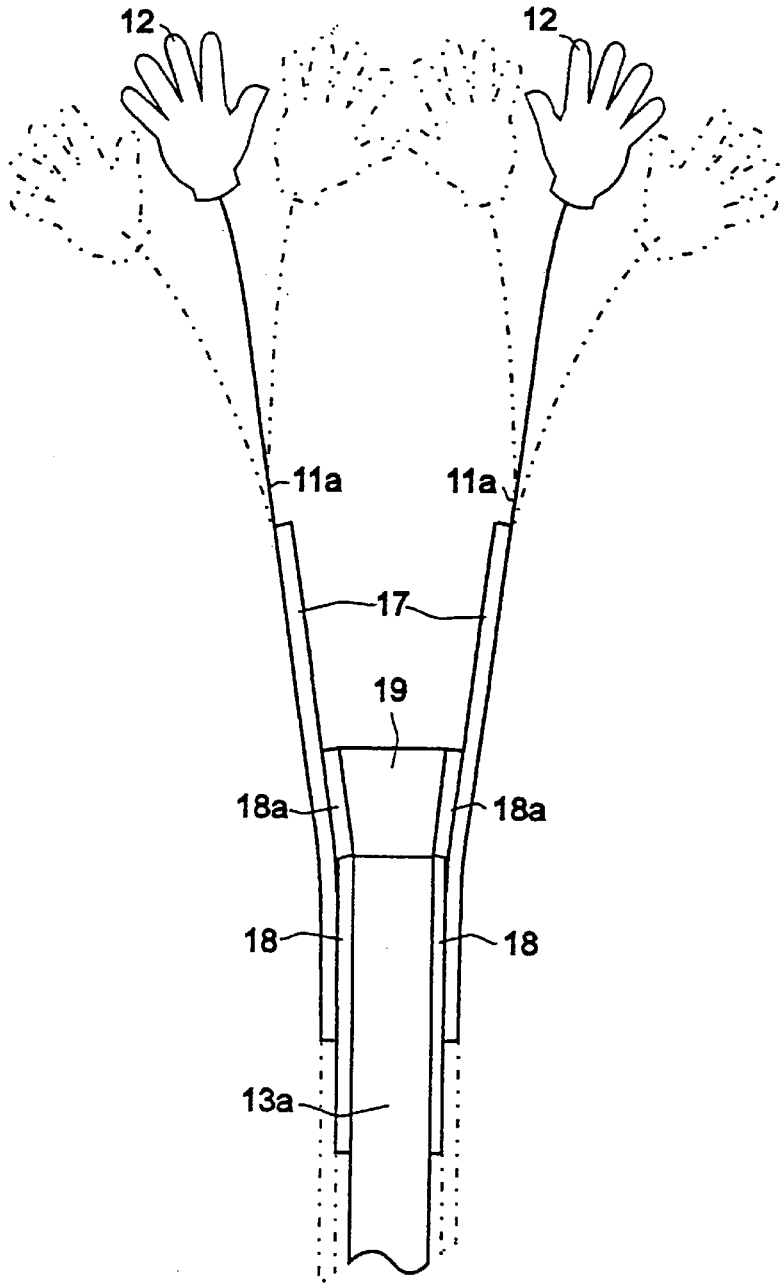
FIG. 9 is a side elevational view of the present invention in another embodiment using Velcro.
Figure 10:
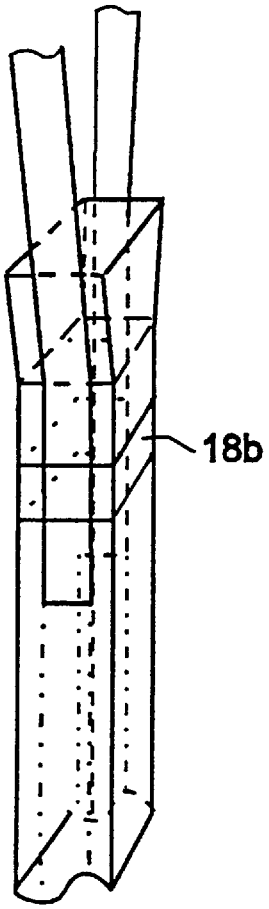
FIG. 10 is a perspective view of the present invention in another embodiment using bands.
Figure 10A:
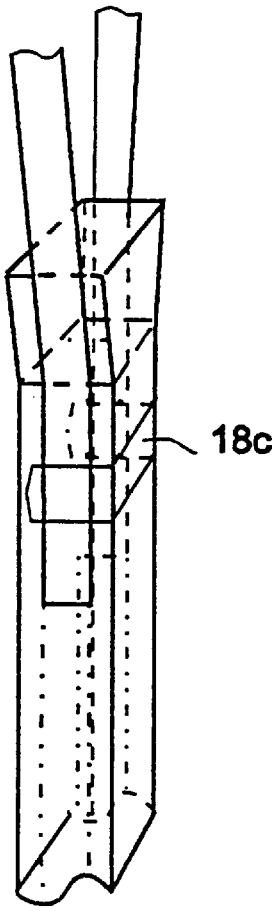
FIG. 10*a* is a perspective view of the present invention in another embodiment using clamps.

In another embodiment of the present invention, illustrated in FIG. 8 and FIG. 9, a portable basketball training aid with moving vision restrictors 12 which simulate the distractive efforts of an opponent's waving hands, thus providing a realistic game condition distraction during practice sessions, is provided having flexible supports 11 of a predetermined width and length and of any suitable material, such as a high impact polymer composite, plastic, a suitable wood or acrylic so that it is both lightweight and durable and of such flexibility and strength as to undergo bending deflection responsive to air movement so as to enable the vision restrictors 12, affixed to the top of each flexible support 11*a*, to move in the presence of minimal wind. Affixed to the support side of each flexible support 11*a* is a Velcro strip 17 suitable to attach to the complementary Velcro strip 18 which is affixed to the rigid support member. The Velcro strips 18, extend a predetermined length of the rigid support member 13*a* so as to accomodate various attached positions of the complementary Velcro strip 17. This allows adjustment for players of different heights. Altermative means of secruing the flexible vision restricting supports in place, such as constriction bands FIG. 10, 18*b* and clamps, such as C clamps or spring clamps FIG. 10*a*, 18*c* could be used.

On top of the rigid support member 13*a* sits a truncated wedge 19 which exceeds the width of the rigid support member 13*a* at it's widest point by a predetermined width, and is secured by Velcro 18*a* which is attached to the sides adjacent to the flexible support member 11*a*. This forces the distance between the vision restrictors 12 to increase. Other means of forcing separation of the flexible supports 11 such as wedges, shims, constriction bands, etceteras could be used in other embodiments. The bottom of the rigid support member 13*a* is supported by a generic conventional base mount, not shown.

Figure 6:
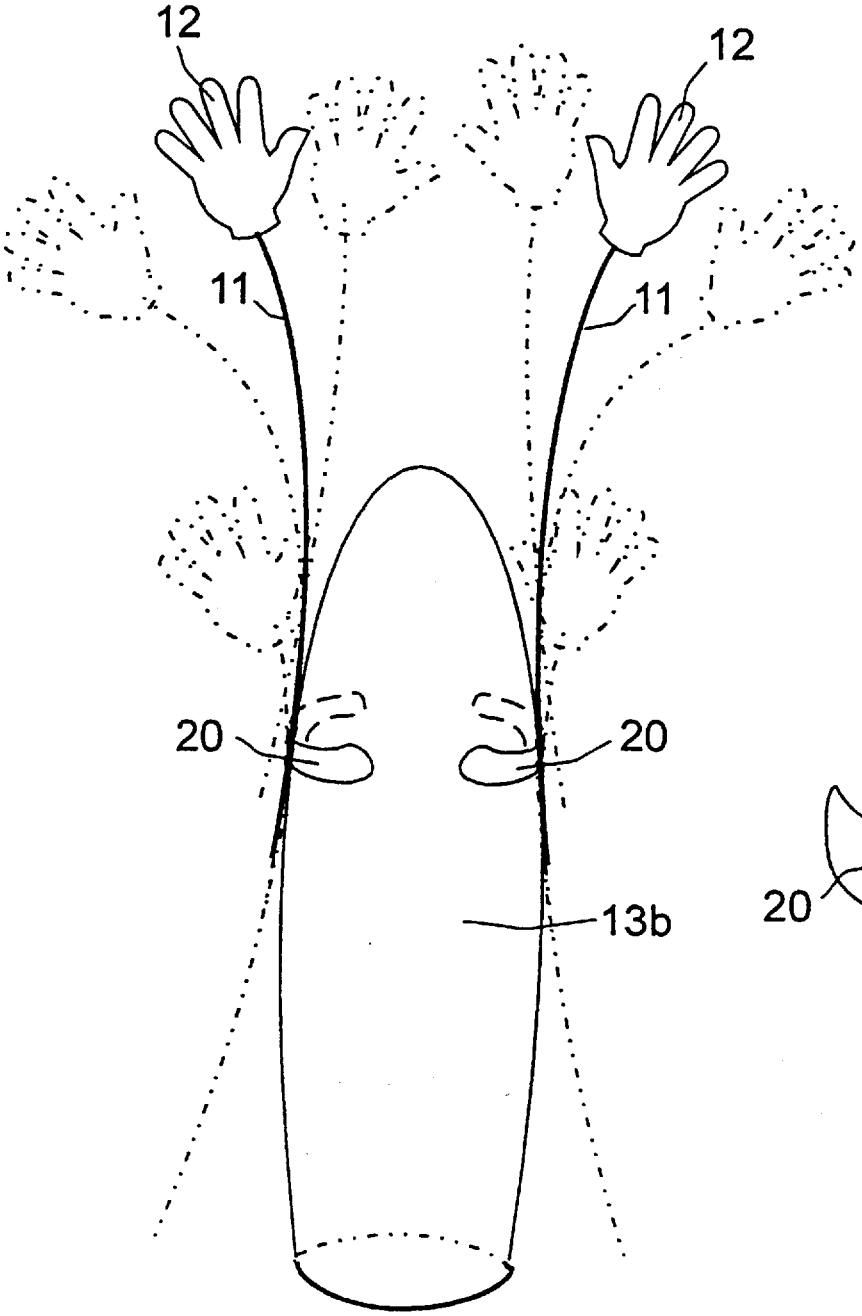
FIG. 6 is a perspective view of the present invention in another embodiment, bop bag.

In an alternative embodiment of the present invention, illustrated in FIG. 6, a portable basketball training aid with moving vision restrictors which simulate the distractive efforts of an opponent's waving hands, thus providing a realistic game condition distraction during practice sessions, is provided having a plurality of flexiable supports 11 being made of any suitable shape, such as rods, strips, etceteras and of any suitable material such as wood, polymer composite, plastic, acrylics, etceteras with vision restrictors 12 affixed at the upper extent.

Figure 7:
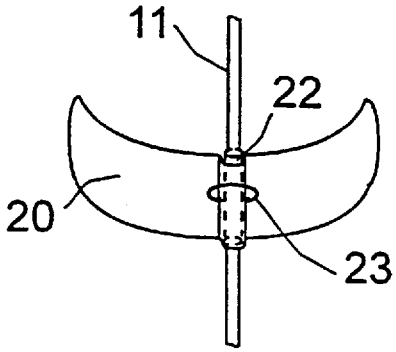
FIG. 7 is a detail of FIG. 6.

A device 20, illustrated in FIG. 7, which both holds the flexiable supports 11 firmly in place and allows for vertical adjustment is affixed to the upstanding support member 13*b*. The upstanding support member 13*b* consist of an inflatable, weighted member, similar to a child's bounce-up punching bag, made of any suitable material such as rubber, polymer composites, plastic, etceteras affixed to which with said device 20, in an approximately parallel vertical position are a plurality of height extendible flexible supports 11. Flexible supports 11 being attached to support member 13*b* by means of a hollow member 22 which is affixed to the support member 13*b* by the device 20. The device 20 is made of tape, fabric or other material, and affixed with glue, sewing, or other appropriate means of attachment. Through which hollow members 22 pass the height extendible flexible vision restrictor supports 11 which are secured in place by a clip or suitable clamp 23 of a predetermined size or another means of constriction. The means of constriction 22 can be released to provide for repositioning as illustrated in FIG. 6, of the height extendible flexible vision restrictor supports 11 to any desired height.

The distance between the vision restrictors 12, thus being determined by the set height of the flexible supports 11 and their affixed location relative to the curve of the inflatable support member 13*b* at that location.

The device of the invention has been described in connection with the preferred embodiment thereof. Obviously, various revisions and modifications can be made to the preferred embodiment while still utilizing the principles of the the invention. As illustrated, Velcro strips could be attached to the lower portion of the flexible support strips with the attaching Velcro strips affixed to a vertical rigid support member. In place of the cap with appropriately spaced holes, a truncated wedge, shim, or other means of forcing separation of the flexiable support members could be used. This assembly reproduces the essence of the invention, that is, height adjustable moving vision restrictors. As further illustrated, still another embodiment of the present invention employees an upstanding support members similar to a child's bounce up punching bag with height adjustable flexible supports attached which also reproduces the essence of the invention, that is, height adjustable moving vision restrictors. This embodiment also provides the additional movement of the bop bag when it is bumped by the player, further enhancing the effect of an opponent's continual, coming at you, distractive efforts.

It is my intention however that all such revisions and modification that are obvious to those skilled in the art will be included within the scope of the following claims. In view of the foregoing, it can be seen that the basketball training aid of the present invention is an improvement over the prior art and overcomes the disadvantages thereof. The training device has a new and improved individually, height adjustable, moving, vision restrictor for providing realistic simulation of game condition distractions during practice sessions. In addition, the training device is movable about a basketball floor and is durable and inexpensive to manufacture.

In operation and use, the training device is placed on a basketball floor or home practice area in the vicinity of an elevated basketball hoop and board so that the vision restrictors extend upwardly and on a line approximately parallel to the face and shoulders of the player. A practicing player attempts to make a shot through the moving vision restrictors. The player will have to adjust to shooting with game conditions, hands-in-your-face, movement and distractions restricting his vision. Such practice requires increased concentration. The player begins practice near the hoop, where it is relatively easy to make a high percentage of shots. After successfully making, for example, seven out of seven shots, the distance to the hoop is increased by approximately one foot, with the device of the invention being moved the same. Shooting continues at the new distance until the same high percentage of shots are made, and the process is repeated until the three-point line is reached. Once the player is able to consistently make a high percentage of shots using the device of the invention, the player will be more conditioned to having vision restrictors moving in his field of vision and will therefore be less distracted by an opponent's attempt to block his vision and distract his attention and better able to maintain his concentration and thus will be more confident in real game situations. The device of the invention thus allows a player to obtain a higher level of shooting confidence in the presence of moving vision restrictors that will enable the player to perform more successfully at any level of competition.

What is claimed is:

1. A portable basketball training aid for use by a basketball player on a basketball floor or home training area, in the vacinity of an elevated basketball hoop and board to improve the player's concentration and shooting accuracy while being distracted by vision restrictors which simulate realistic game conditions, the training device includes a plurality of height extendible flexible supports extending upward from the top of the rigid support member in a direction approximately parallel to the rigid support member, having an upper extent and a lower extent, the lower extent being attached to a moveable member which engages the upstanding support member in such a way as to be held in place and the upper extent being affixed to the vision restrictors, the material of the flexiable support being thin and of such flexibility and strength as to undergo bending deflection responsive to minimal air movement thus simulating the distractive efforts of an opponent's, waving, hands-in-your-face, guarding technique, the vision restrictors in the form of a hand, glove, oval, diamond or rectangle within predetermined size and predetermined weight limits so as to not interfere with the flexibility and function of the flexible supports.

2. The device of claim 1 in which the upstanding rigid support member comprises a rigid hollow support member into which pass a plurality of height extendible flexible supports being made in the shape of rods or strips and of wood, polymer composite, plastic, acrylics, rubber or metal having an upper extent and a lower extent, the lower extent being attached to a compressible anchor member made from a compressible plastic or rubber or, a foam in the shape of a cylinder, prism or cube, which is held in place relative to the rigid hollow member by friction formed at the intersection between the compressible member and the inside wall of the rigid hollow member which is held in place by means of compression of the material which in its uncompressed state is of a width greater than the inside width of the rigid hollow member.

3. The device of claim 2 in which the anchor member is retained from exiting the rigid hollow member by a cap so as to prevent passage of the anchor member outwardly of the rigid hollow member, the plurality of flexible supports for the vision restrictors pass through the cap through openings which are offset from the center to force seperation of the vision restrictors when in their extended positions.

4. The device of claim 1 in which said height extendible flexible supports are strip, of a predetermined width and a predetermined length, being thin and made of polymer composite, plastic, wood, acrylic or metal so as to be both lightweight and durable and of such flexibility and strength as to undergo bending deflection responsive to air movement so as to enable said vision restrictors affixed to the top of each said flexible support strip, to move in the presence of minimal wind, and affixed to the lower side of each said flexible support strip is a Velcro strip of predetermined length and width suitable to attach to the complimentary Velcro strip of predetermined length and width which is affixed to said rigid support member, said Velcro extending a predetermined length of said support member so as to accomodate various attached positions which allow adjustment for players of different height, on top of said support member sits a truncated wedge which exceeds the width of the support member at it's widest point by a predetermined width and is held in place by Velcro strips on the outer sides which complement adjacent Velcro on the flexible support member, said truncated wedge forces increased distance between said flexible supports.

5. The device of claim 4 in which the upstanding rigid support member consist of a rigid member made of wood, a polymer composite, plastic, acrylics, or metal affixed to which in a parallel position are a plurality of height extendible flexible supports being made in the shape of rods or strips, and being made of polymer composite, plastic, wood, acrylics or metal, having an upper extent and a lower extent, the lower extent being attached to said rigid support member by means of clamps which can be moved to reposition said height extendible flexible vision restrictor supports to the desired height, affixed to the upper part of said rigid support member is a member which forces said flexible supports to separate as the overall height of the training device is increased.

6. A portable basketball training aid for use by a basketball player on a basketball floor or home training area, in the vacinity of an elevated basketball hoop and board to improve the player's concentration and shooting accuracy while being distracted by vision restrictors which simulate game condition distractions, the training device includes a plurality of height extendible flexible supports extending upward from a support member in a direction approximately parallel to the support member, having an upper extent and a lower extent, the lower extent being held in place and the upper extent being affixed to the vision restrictors, the material of the flexiable supports being thin and of such flexibility and strength as to undergo bending deflection responsive to minimal air movement thus providing movement simulating the distractive efforts of an opponent's waving hands.

7. The device of claim 6 in which the upstanding support member consist of an inflatable, weighted member, similar to a child's bounce-up punching bag, made of rubber, vinyl, polymer composites, or plastic, affixed to which in an approximately parallel position are a plurality of height extendible flexible supports being made in the shape of rods or strips and made of wood, plastic, acrylics or metal, having an upper extent and a lower extent, the lower extent being attached to said support member by means of a hollow member which is affixed to the said support member by a device made of tape, fabric, Velcro or plastic, and affixed with glue, sewing, rubber cement, Velcro or plastic, which holds said hollow member in place on said inflateable support member and through which said hollow members pass said height extendible flexible vision restrictor supports which are secured in place by clips, or clamps as a means of constriction which can be released to provide for repositioning of said height extendible flexible vision restrictor supports to the desired height, the distance between the vision restrictors, thus being determined by the set height of said flexible supports and the affixed location of said hollow member and the curve of said inflatable support member at that location, whereby said device substantially departs from the conventional concepts and designs of the prior art, and in doing so provides an apparatus primarily developed for the purpose of providing a moving, vision restricting, training aid which simulates game enviornment distractions during individual basketball practice sessions, and which is used as a training aid by coaches, instructors, and so the player will be more conditioned to having vision restrictors moving in his field of vision and will therefore be less distracted by an opponent's attempt to block his vision and distract his attention and, therefore, be better able to maintain his concentration and thus will be more confident in real game situations.

* * * * *